US005603623A

United States Patent [19]

Nishikawa et al.

[11] Patent Number: 5,603,623

[45] Date of Patent: Feb. 18, 1997

[54] LOCK MECHANISM FOR A CONNECTOR

[75] Inventors: Kazuo Nishikawa, Uji; Kenji Nakamura, Tokyo, both of Japan

[73] Assignee: Nellcor Puritan Bennett Incorporated, Pleasanton, Calif.

[21] Appl. No.: 256,203

[22] PCT Filed: Dec. 28, 1992

[86] PCT No.: PCT/JP92/01736

§ 371 Date: Dec. 1, 1994

§ 102(e) Date: Dec. 1, 1994

[87] PCT Pub. No.: WO93/13573

PCT Pub. Date: Jul. 8, 1993

[30] Foreign Application Priority Data

Dec. 27, 1991 [JP] Japan ..... 3-113513 U

[51] Int. Cl.[6] ..... H01R 13/44

[52] U.S. Cl. ..... 439/144; 439/147

[58] Field of Search ..... 439/372, 373, 439/304, 144, 147, 136, 133

[56] References Cited

U.S. PATENT DOCUMENTS

| | | | |
|---|---|---|---|
| 2,552,061 | 5/1951 | Popp et al. | 173/330 |
| 3,781,495 | 12/1973 | Splingaerd | 439/144 |
| 4,109,095 | 8/1978 | Kling et al. | 439/144 |
| 4,245,875 | 1/1981 | Shaffer et al. | 439/144 |
| 4,911,646 | 3/1990 | Marson et al. | 439/144 |

FOREIGN PATENT DOCUMENTS

| | | |
|---|---|---|
| 808134 | 7/1951 | Germany . |
| 1207983 | 12/1965 | Germany . |
| 57-107284 | 7/1982 | Japan . |
| 63-120378 | 8/1988 | Japan . |

*Primary Examiner*—Hien Vu

*Attorney, Agent, or Firm*—Townsend and Townsend and Crew LLP

[57] ABSTRACT

A lock mechanism for a built-in connector (2) fixed in a casing (10) constituting the main body of a diagnostic apparatus, etc., to an external plug (3) connected to a cable of a measurement sensor, etc. The built-in connector (2) is fixed inside the open portion of a panel (11) of the casing (10) of the apparatus, and shutters (4; 6; 7) for closing the open portion (13) are arranged in front of the built-in connector (2) in such a fashion as to form an opening (12) for receiving the plug (3) between the front of the connector and the shutters (4; 6; 7). The plug is locked when its rear portion is engaged with notches (41, 61, 71) formed in the shutters.

3 Claims, 5 Drawing Sheets

LOCK MECHANISM FOR A CONNECTOR

FIELD OF TECHNOLOGY

The present Invention relates to a lock mechanism for a connector which links a connector built into a casing with a plug connected to a cord.

TECHNOLOGICAL BACKGROUND

Some diagnostic devices used in medicine have various types of diagnostic sensors which are separate from the main body of the measurement unit and are connected to it by a cord. In devices used on a relatively frequent basis for diagnostic applications, there is a built-in connector on the front of the operating panel of the main body of the device, or on a panel surface which is conveniently located for operating measurement devices such as sensors. A plug which fits into this connector is attached to the cord or cable containing an electric wire which sends electrical signals from the sensor to the main body of the unit, and the cord is disconnected by pulling the plug out of the connector.

This type of plug on the cord side and built-in connector on the device side make the sensor interchangeable, facilitate repair tests, and make exchanging and proper use of sensors easy. In cord connections in conventional sensors, to cite an example, after the plug on the cord side is inserted into the built-in connector on the main body of the unit, a nut installed on the cord side connector in such a manner that it can be rotated is screwed onto a threaded portion on the outer periphery of the built-in connector in order to prevent the plug from being pulled out.

The above connector for diagnostic devices, etc., uses a nut-type fixing mechanism in order to prevent the plug from being pulled out, thus providing a solid electrical connection, but its drawback is that when the connector is pulled out, it is necessary to rotate the nut-type fixing device, making operation inconvenient.

Moreover, in cases where a sensor is not being used, the connector on the device side is exposed on the surface of the panel, which may lead to the accumulation and adhesion of dust on the connector, and in an environment in which substances such as water and drugs are used, there is a risk that liquid may adhere to the connector. For this reason, a plastic cap is placed on the connector, or a cap nut is screwed on in order to cover it when the connector is not in use. However, these operations are frequently forgotten, and when the connector is used for measurement without removing liquids which have adhered to it, errors may occur in measurement values, or measurement may become impossible due to poor conduction.

In recent years, in order to prevent the transmission of infections via equipment, the method of discarding the diagnostic sensor together with the cord has come into widespread use, but in this case, the cord side connector, which is equipped with a fixing device to prevent the cord from being pulled out, has a complex structure, inevitably making the sensor expensive.

In consideration of the above problems, the present Invention provides a lock mechanism for a connector for diagnostic devices, etc., in which the front surface of the built-in connector of the device can be closed when the connector is not in use, no particular fixing operation is required when the connector is connected, and the cord is reliably prevented from being pulled out.

PRESENTATION OF THE INVENTION

The present invention comprises a lock mechanism for a built-in connector which engages a plug connected to an electrical cord, in which the built-in connector is fixed inside the open portion of the panel of the casing, shutters for closing the open portion are arranged in front of the built-in connector in such a fashion as to form an opening for receiving the plug between the front of the connector and the shutters, and the plug is locked when its rear portion is engaged with notches formed in the shutters.

This allows the plug to be rapidly plugged into the connector and ensures that it can be reliably prevented from being pulled out and protected from dust and water.

SIMPLIFIED EXPLANATION OF THE FIGURES

PREFERRED EMBODIMENT OF THE INVENTION

Figure 1A:
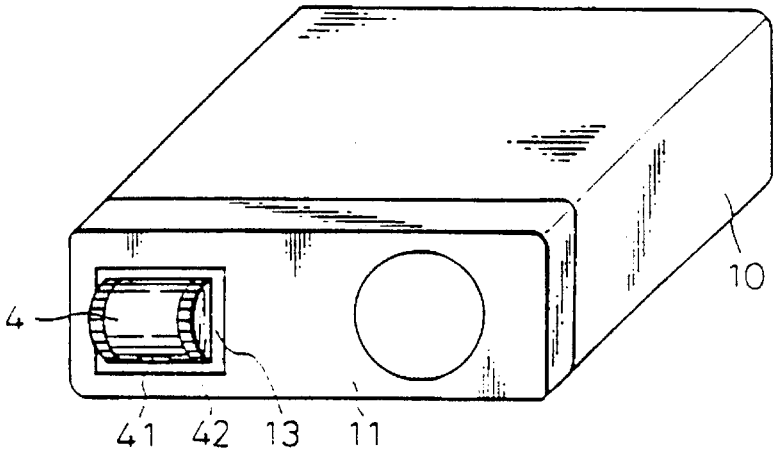
FIGS. 1A–1C show a front oblique view of the casing of a diagnostic device, etc, equipped with a connector lock mechanism with a rotating-type shutter, with 1(A) showing a view when not in use, 1(B) showing a view when the plug is connected, and 1(C) showing the status during continuous use.
Figure 1B:
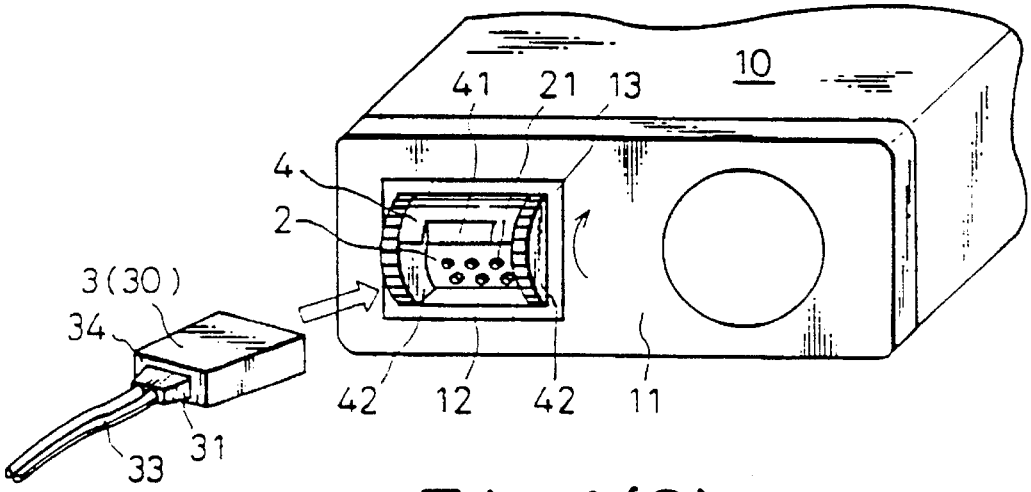
Figure 1C:
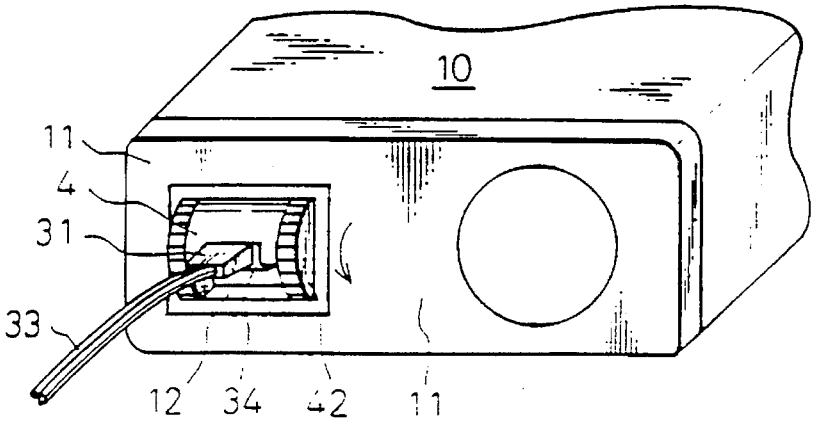

As an example, FIGS. 1A–1C show an oblique view, seen from the front of the device, of the connector lock mechanism of the Invention installed in the casing (10) of a pulse oximeter.

In FIG. 1 (B), there is a rectangular open portion 13 in the operating panel 11 on the front of the device, and the connector is fixed inside the open portion so that the terminal pins of said open portion 21 protrude forward.

A curved shutter 4 which moves freely up and down is installed inside the open portion 13 in the operating panel 11, and there is an opening 12 between the shutter 4 and the connector 2 for receiving the plug 30 at the end of the cord 33 from the oxy-sensor for blood oxygen measurement (not shown).

As shown in FIG. 1 (A), when the shutter 4 is down, the shutter 4 covers and conceals the connector 2 inside the opening 12, the outer surface of said shutter 4 curves outward slightly from the open portion 12 of the panel 11, and its left and right edges have rough serrations (indentations) used for moving the shutter up and down with the fingers.

Figure 3A:
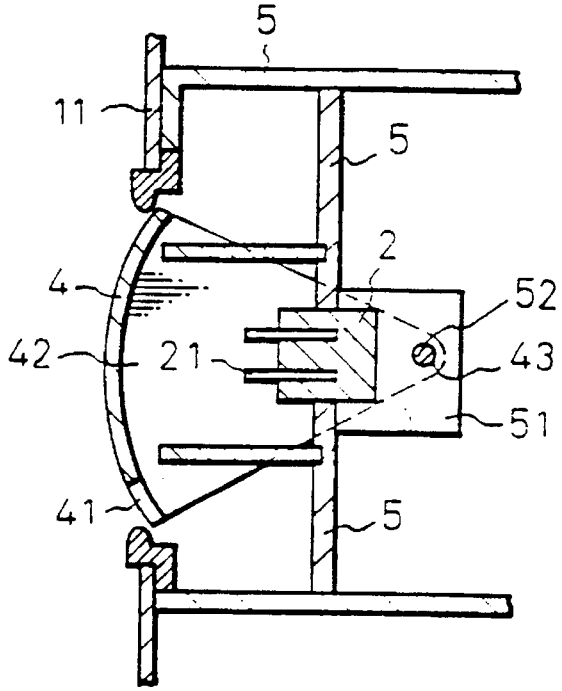
FIGS. 3A–3B are a sectional view of the connector lock mechanism shown in FIGS. 1A–1B, with 3(A) showing a view when not in use and 3(B) showing the status during continuous use.
Figure 3B:
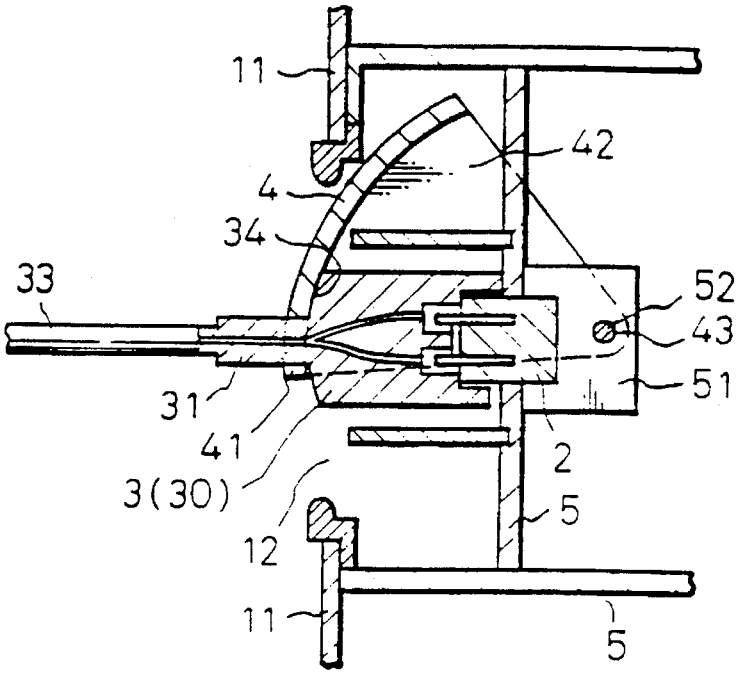

Looking at FIG. 3 (A), which shows a sectional view of the connector lock mechanism of this practical example, the connector 2 is installed on a fixing component 5 which is built into the inside of the panel 11, the cross section of the shutter 4 forms a circular arc, and as will be discussed below, the shutter can be moved upward and downward and is installed in the aforementioned open portion of the panel.

Figure 2:
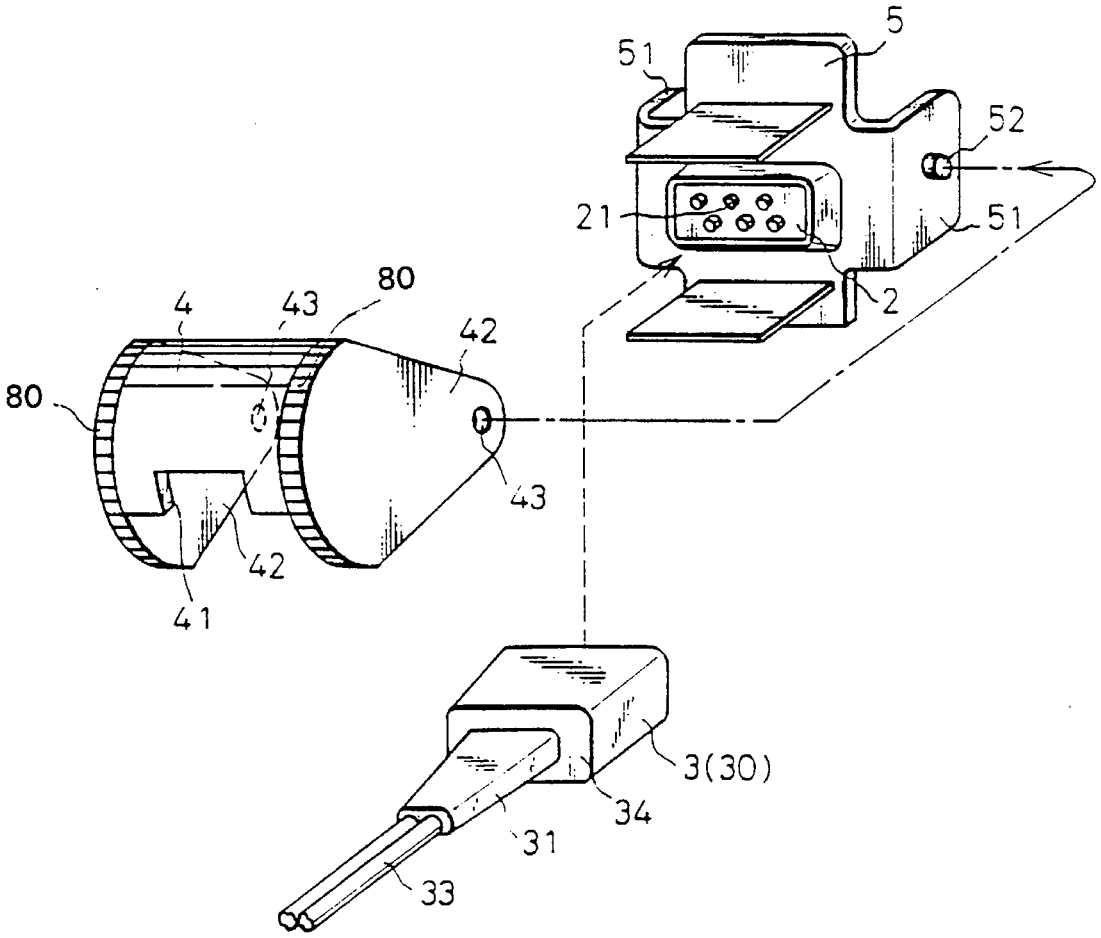
FIG. 2 is an oblique view showing the relation between the connector fixing component, the rotating-type shutter, and the plug of the connector lock mechanism shown in FIGS. 1A–1B.

Looking at FIG. 2, which shows an oblique view of the relation between the shutter 4 and the connector fixing component, the curved shutter 4 is attached at its edges to a pair of wing-shaped plates 42, 42 which face each other and whose edges form a circular arc. The wing-shaped plates 42, 42 have axial holes 43, 43 located at the center of the aforementioned circular arc. Axial pins 52, 52 which protrude outward are located on the pair of parallel side plates, which are bent backward from the two sides of the connector fixing component 5 to face each other. The arc-shaped ends 80 form a user-movable knob as a protrusion beyond shutter 4. Ends S0 include ridges for allowing the user to move the shutter. Shutter 4 and plates 42 are entirely on the same side of axle pins 52, enabling the shutter to close under its own weight.

The shutter 4 is supported in a pivoting manner on the aforementioned axial pins 52, 52 which fit into the axial holes 43, 43 in the aforementioned wing-shaped plates 42, 42, which form a single piece with the shutter 4, and it can be moved upward and downward by rotating it around said axial pins.

On the lower edge of the shutter 4 there is a slot-shaped notch 41. The width of this notch 41 is less than that of the main body of the plug 3 connected to the end of the connecting cord 33 from the sensor for blood oxygen measurement (not shown) of the present example, and greater than that of the stepped connecting piece 31 between the cord 33 and the main body of the plug 30. The stepped surface 34 of the rear part of the main body of the plug 30 can be brought into contact with the inside surface of the shutter surface at the edge of the aforementioned notch.

In using the mechanism, if the shutter 4 is pushed upward with the fingers from a position in which the open portion 12 at the front part of the connector 2 is closed, as shown in FIGS. 1 (A) and 3 (A), the shutter 4 rotates, and as shown in FIG. 1 (B), the front of the connector 2 is released, making it possible to insert the plug 3 into the connector 2. Next, as shown in FIGS. 1 (C) and 3 (B), if the shutter 4 is moved in a downward direction, the shutter 4 covers the main body of the plug 30, and the aforementioned notch 41 of the shutter 4 fits around the aforementioned stepped connecting piece 31 of the plug 3, i.e., the notch 41 of the shutter 4 engages with the stepped connecting piece 31 at the rear of the plug 3. Moreover, as shown in FIG. 3 (B), the front and back of the plug 30 are inserted between the connector 2 and the shutter 4, and with respect to up-and-down and right-left movement, as the plug 3 is held in place by the electrical connecting pins 21 of the plug 3 inserted into the connector 2, it remains solidly in contact with the connector 2.

When the plug is inserted in this manner, as at least the upper part of the entire main body 30 of the plug 3 and the connector 2 is covered, contamination of the connector 2 by dust or splashing of liquid is prevented, and at the same time, the edge of the notch 41 in the shutter 4 is in contact with the stepped surface of the rear part of the main body of the plug 3, making it possible to prevent the plug 3 from being pulled out.

In the case of removal of the plug 30 from the connector 2 when the unit is not in use or the sensor is being exchanged, if the above order is reversed, the plug can easily be removed. When the unit is not in use, as the shutter 4 falls under its own weight, the front surface of the connector is covered, preventing contamination from dust, etc.

The above practical example features a type of mechanism in which the shutter 4 moves upward and downward, but as explained below, it can also be easily used in a design which moves left and right.

Figure 4A:
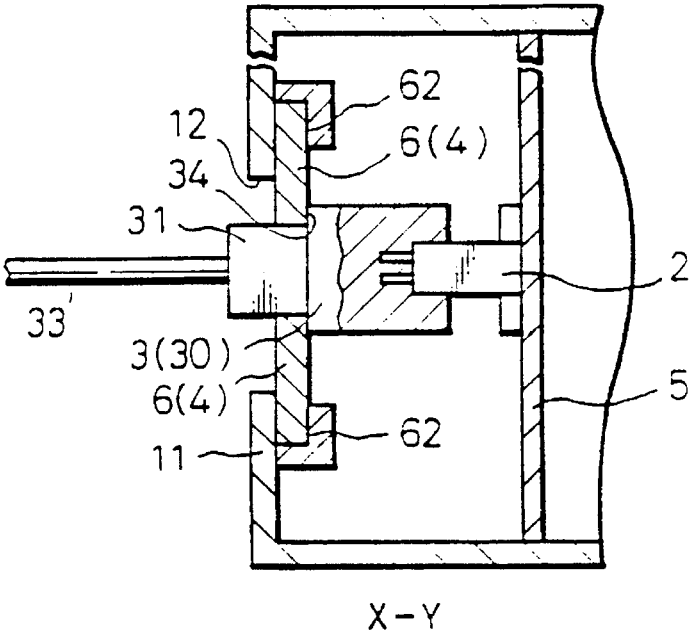
FIGS. 4A–4B show a sectional view 4(A) and a front oblique view 4(B) of the connector lock mechanism having a sliding shutter along the surface of the device panel.
Figure 4B:
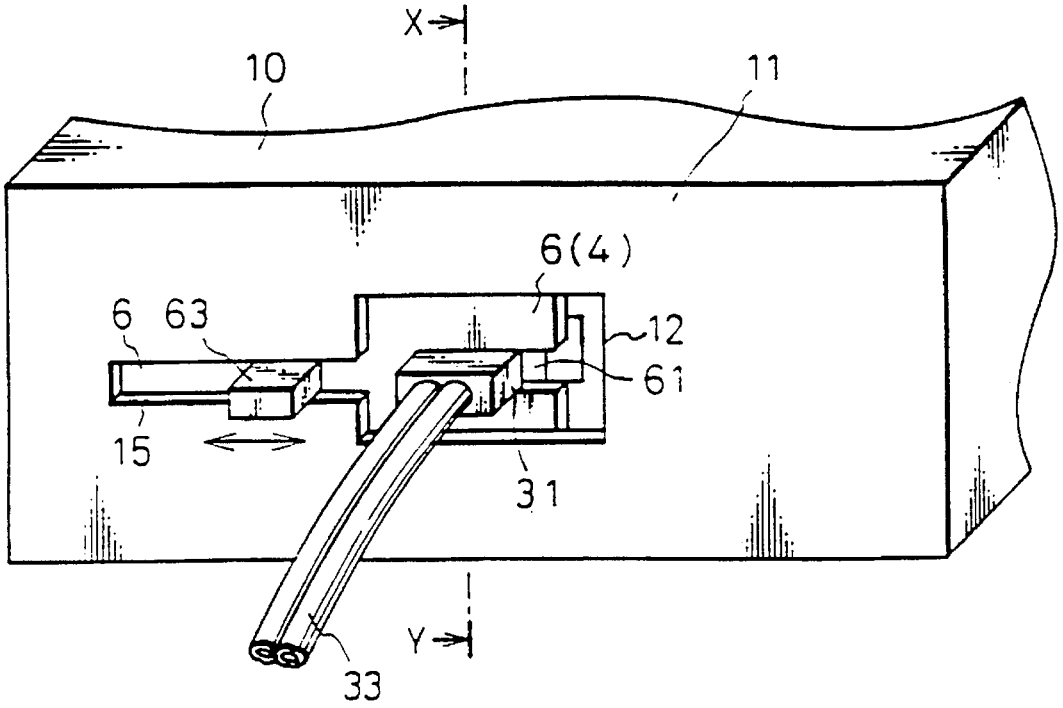

Looking at FIG. 4 (A), which shows a sectional view of a connector lock mechanism with a sliding shutter 6 (4), and FIG. 4 (B), which shows an external oblique view of this shutter, the flat shutter 6 is supported above and below by sliding guides 62, 62 which slide left and right along the open portion of the panel 12 on the front of the connector 2 inside the panel of the unit.

The shutter 6 has a slot-type notch 61 in one of its ends which extends in the direction of sliding, and as shown in FIG. 4 (A), the width of the notch 61 is smaller than the thickness of the main body 30 of the plug connected to the connector 2, and slightly larger than the thickness of the stepped connecting piece 31 at the rear of the plug. In connecting the plug 3, it may be inserted into said notch 61, and the upper and lower surfaces of the notch 61 can be slid while remaining in contact with the stepped surface of the plug 34.

The shutter 6 has an operating knob 63 which protrudes through the rectangular slot cut into the panel 11.

FIGS. 4 (A) and (B) show a situation in which the plug 3 is plugged into the connector 2, the stepped connecting piece 31 of the plug 3 is inserted into the notch 61, and the plug cannot be pulled out.

When the shutter 6 is slid to the left using the operating knob 63 from the position shown in FIG. 4 (B), the open portion of the panel 12 is opened, the engagement of the plug 3 in the notch 61 is released, and the plug can be pulled out or plugged in.

When the unit is not in use, if the operating knob 63 is moved to the right and the shutter is slid across, the open portion of the panel 12 can be completely closed.

Instead of the type in which the shutter 6 is moved left and right in the front surface of the panel 11 (FIGS. 4A–4B), it is also possible to use a system in which it is slid upward and downward. In this case, the open portion of the panel 12 can easily be closed by the weight of the shutter.

Figure 5A:
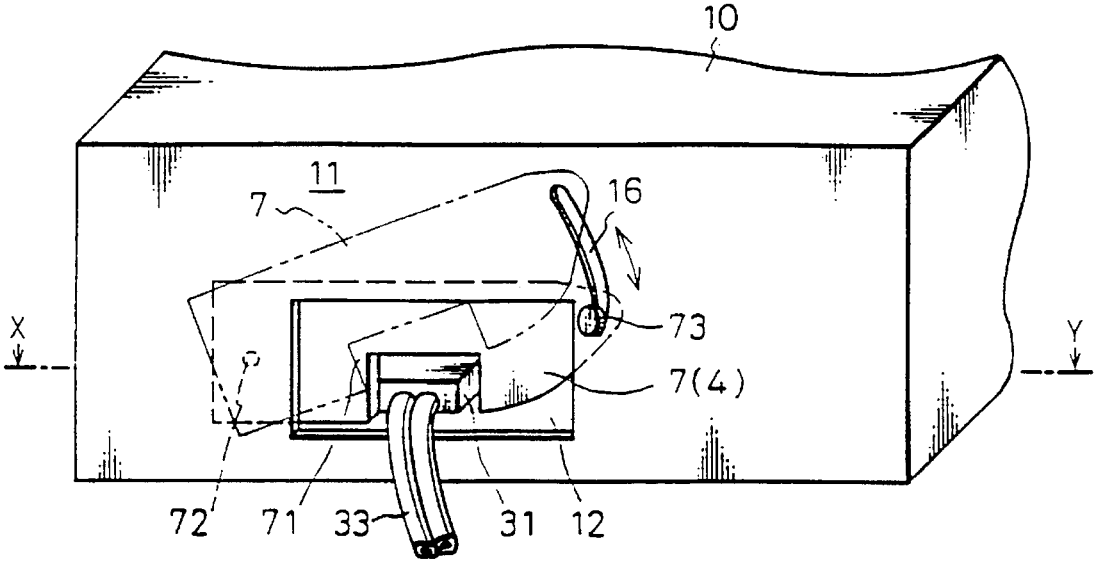
FIGS. 5A–5B show a front oblique view 5(A) and a sectional view 5(B) of the connector lock mechanism having a rotating shutter along the surface of the panel.
Figure 5B:
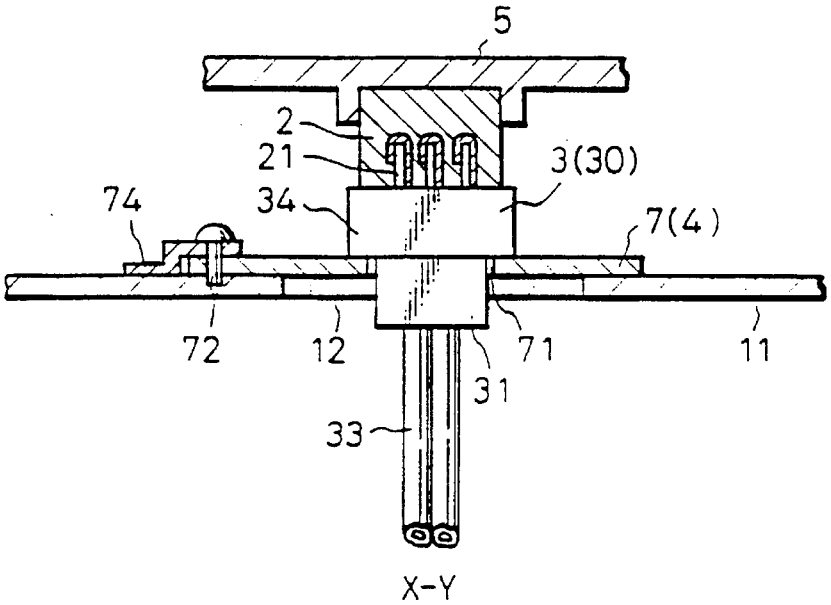

Looking at FIGS. 5A–5B, which show a lock mechanism of a connector using a shutter 7 which rotates along a panel 11, the shutter 7 which is equipped with a notch 71 has one of its horizontal edges supported in a freely rotating manner by a supporting axis 72 inside the panel, and the other edge is supported by the operating knob 73 which protrudes through a circular arc-shaped slot 16.

When the operating knob 73 is moved upward and downward along the circular arc-shaped slot 16, the shutter 7 rotates upward around the center of the supporting axis 72, and the front of the connector 2 inside the open portion 12 of the panel 11 is released, making it possible to connect the plug 3 to the connector. Next, when the operating knob 73 is pushed downward, the notch 71 in the shutter 7 engages with the stepped connecting piece 31 at the rear of the plug 3, and as shown in FIG. 5 (B), the front and back of the plug 30 are inserted between the connector 2 and the shutter 7. With respect to up-and-down and right-left movement, the unit is fixed by electrical connecting pins 21 in the plug 3 inserted into the connector 2. This ensures that the plug 3 is securely locked into the connector 2.

The connector lock mechanisms of all of the above practical examples have plugs 3 with rectangular sections, but the present Invention also allows the application of a plug with a circular section. In this case, the end of the notch in the shutter should be of a circular arc shape in order to conform to the external periphery of the plug. Moreover, in the above practical examples, a single shutter was used in all cases, but the invention is not limited to this, and it is also possible to use a mechanism in which the plug is inserted between two shutters on the top and bottom and left and right respectively, which increases the protective effect against dust, liquids, etc.

Furthermore, in the above practical examples shown in FIGS. 4A–4B and 5A–5B, when the connector is not being used, the notch in the shutter is completely concealed by the reverse side of the panel, and the open portion of the panel is completely covered by the shutter, so this is preferable from the standpoint of protection against dust and water. The above practical examples were also examples of connector lock mechanisms in which there was a connection between the diagnostic unit and a sensor cord, but the Invention is not limited to this, and it can be used with a broad range of devices, such as various measurement units and home electronic equipment.

POSSIBILITIES FOR INDUSTRIAL USE

In the present Invention, there is a hole inside the open portion of the panel between the shutter and the built-in connector for receiving a plug on the front surface of a connector built into the casing of a diagnostic apparatus, etc., and as the shutter can be moved in such as fashion as to close the front portion of said connector, when the unit is not in use, the front portion of the connector is closed, preventing contamination from dust and splashing of liquid, and when it is in use, the plug is plugged into the connector and fixed in the aforementioned hole.

When the shutter is moved in the direction of the plug attached to the connector, the notch in the shutter engages the rear portion of the plug, allowing the plug to be fixed in place, the plug is prevented from being pulled out by the external force of the cord, and as the shutter almost completely closes the open portion of the panel, it can play a role in preventing contamination from splashing liquid.

We claim:

1. A locking mechanism for a built-in electrical connector, said connector being fixed inside an open portion of a panel in a casing, said connector being a type of connector which engages a plug connected to an electrical cord, said lock mechanism comprising:

a curved shutter for closing said open portion of said panel, said shutter being arranged in a front portion of said built-in connector, an opening being formed for receiving said plug between said front portion of said connector and said shutter;

at least one notch formed in said shutter, wherein said plug is locked into said connector when a rear portion of said plug is engaged in said notch formed in said shutter; and a pair of parallel components attached to said shutter by an axle and supported inside said panel, such that said shutter is capable of rotating about said axle to retract into said open portion of said panel;

said shutter forming an arc such that the entire arc is on the same side of said axle as said open portion of said panel, such that said shutter will close under its own weight.

2. The locking mechanism of claim 1 further comprising a user-movable knob consisting of an arc-shaped protrusion of said parallel components beyond said shutter.

3. The locking mechanism of claim 2 further comprising a series of horizontal ridges on said protrusions to facilitate user grasping.

* * * * *